United States Patent [19]

Jensen

[11] 4,266,897

[45] May 12, 1981

[54] LADING TIE ANCHOR

[75] Inventor: Finn Jensen, Dolton, Ill.

[73] Assignee: Illinois Railway Equipment Company, Chicago, Ill.

[21] Appl. No.: 21,573

[22] Filed: Mar. 19, 1979

[51] Int. Cl.[3] ..... B61D 45/00

[52] U.S. Cl. ..... 410/113

[58] Field of Search ..... 410/113, 114, 102, 152; 105/409

[56] References Cited

U.S. PATENT DOCUMENTS

| | | | |
|---|---|---|---|
| 3,014,436 | 12/1961 | Johnson | 410/113 |
| 3,769,917 | 11/1973 | Snyder et al. | 410/113 |
| 3,842,756 | 10/1974 | Marulic | 410/113 |
| 3,853,071 | 12/1974 | Snyder et al. | 410/113 |
| 3,996,861 | 12/1976 | Santho | 410/113 |
| 4,062,297 | 12/1977 | Snyder et al. | 410/113 |

*Primary Examiner*—Richard A. Bertsch

*Attorney, Agent, or Firm*—Lockwood, Dewey, Alex & Cummings

[57] ABSTRACT

Lading tie anchor installed by welding a tie bar in a scoop in a doorpost channel or the side lining of a steel-lined box car or the like. The lading tie anchor installation includes a tie bar which has a repetitive series of novel formations in its length which impart to it adequate strength while being formed of a relatively light gauge metal strip. The scoop and lading tie anchor have cooperative locator formations therein which facilitate fast and accurate installation.

7 Claims, 9 Drawing Figures

A
B
3
4
5
6
7
8
15
16
17

LADING TIE ANCHOR

The invention relates, generally, to new and improved lading tie anchors installed by welding in the side lining and doorpost channels of a box car, particularly one that is steel-lined. More specifically, the invention relates to such a lading tie anchor wherein the scoop welded in a side wall or doorway post has tie bar locator formations therein and the tie bar is formed from a relatively light guage metal strip and has in its length a series of repetitive formations which impart adequate strength which otherwise would be inadequate. Included in the series of repetitive formations are locator formations which have cooperative engagement with the locator formations in the scoop permitting fast and accurate installation even by relatively unskilled workmen.

Lading tie anchors of the general type and construction to which the present invention relates are known and have been disclosed in several patents including, U.S. Pat. No. 3,014,436, dated Dec. 26, 1961; U.S. Pat. No. 3,769,917, dated Nov. 6, 1973; and U.S.Pat. No. 3,853,071, dated Dec. 10, 1974.

The nature and purpose of lading tie anchors in box cars and the like are well-known. Briefly, they provide a plurality of secure anchors in the side walls of bax cars through which flexible anchor straps, bands or ties may be passed for securing cargo within the box cars. In box car construction, multiple lading tie anchors are required and they usually account for a significant portion of the cost of the box cars. The cost of the lading tie anchors is, in part, attributable to material cost and, in part, to the cost of installation. Accordingly, whatever can be done to decrease such costs becomes an important objective in box car construction provided, of course, that neither the quality, strength nor the convenience of use of the lading tie anchors are not impaired.

It will be understood that the object of this invention, generally stated, is the provision of new and improved lading tie anchor means for box cars and the like characterized in being economical to produce and convenient to install.

A more specific object of the invention is the provision of such new and improved lading tie anchor means incorporating tie bars formed of relatively light gauge sheet metal and having cooperative locator formations therein and also in the so-called scoop members that are mounted in the side lining and doorpost channels of box cars and the like.

Certain other and more specific objects of the invention will become apparent from the following detailed description of two preferred embodiments of the invention shown in the accompanying drawings, wherein.

Figures 1, 2, 3:
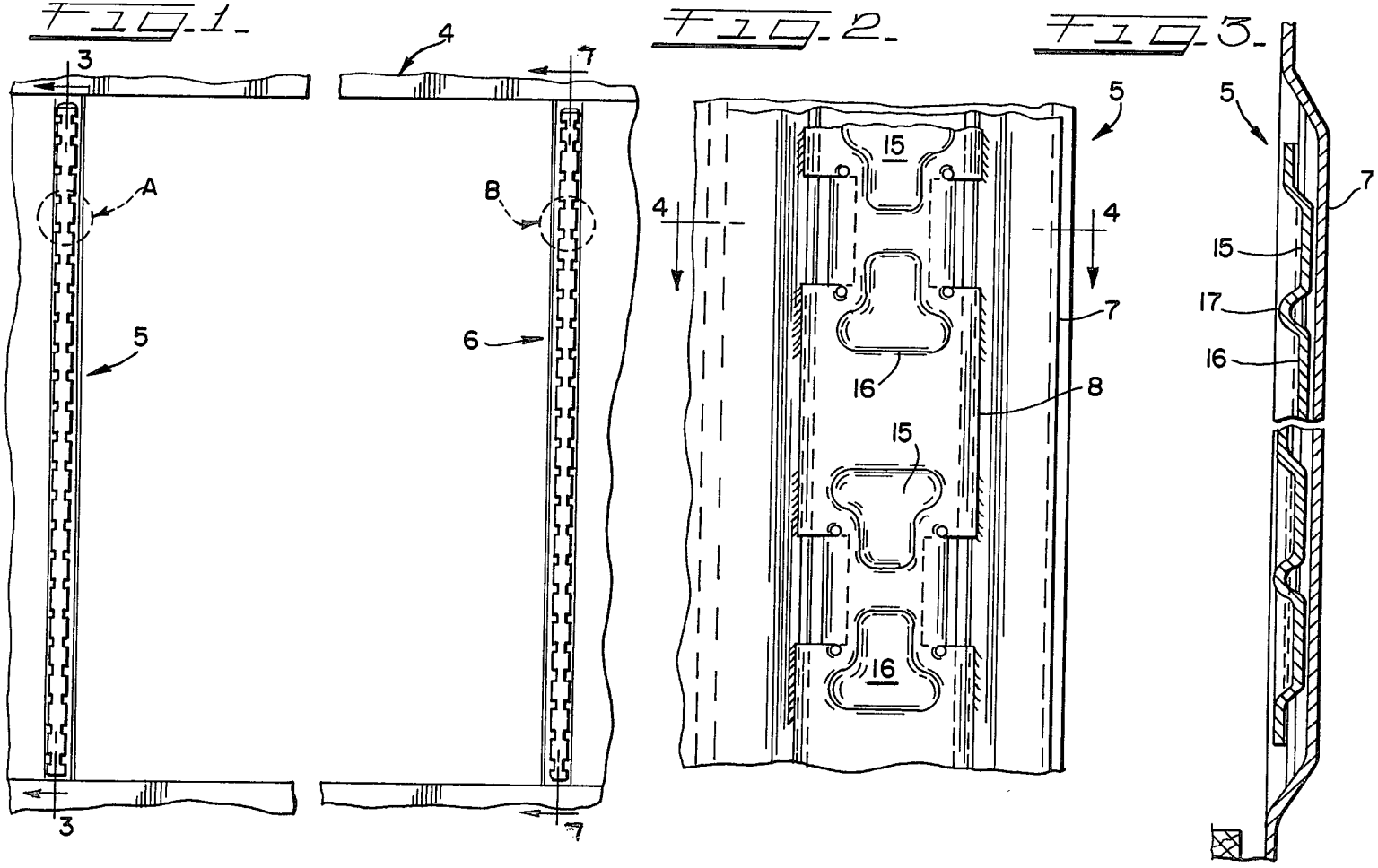
FIG. 1 is a fragmentary elevational view of the side wall of a box car taken from the interior thereof and showing somewhat diagrammatically lading tie anchor installations incorporating embodiments of the present invention.
FIG. 2 is a fragmentary elevational view on enlarged scale of the portion of the lading tie anchor within the broken line circle A in FIG. 1 and showing one embodiment of the present invention.
FIG. 3 is a fragmentary vertical sectional view taken on line 3—3 of FIG. 1 and on the same enlarged scale as FIG. 2 of the lading tie anchor embodiment shown in FIGS. 2–5.

Referring to FIG. 1, a section of the interior sidewall of a conventional railway box car is indicated generally at 4 showing two vertical lading tie anchor installations indicated generally at 5 and 6. Each of the lading tie anchor installations 5 and 6 is comprised of a repetitive series of formations and it will, therefore, suffice to describe in detail the portions of the installations which have been designated A and B, respectively, in FIG. 1. Two illustrative embodiments of the invention will be described, one (A) in connection with FIGS. 2–5 and the second (B) in connection with FIGS. 6–9. It will be understood that, in practice, only one form of lading tie anchor will be installed in a box car.

Figure 4:
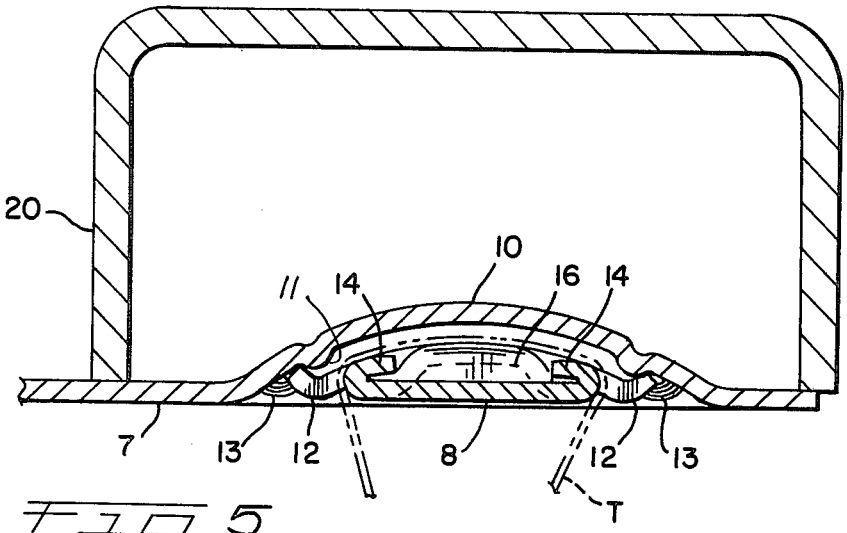
FIG. 4 is a horizontal sectional view on an enlarged scale taken on line 4—4 of FIG. 2.
Figure 5:
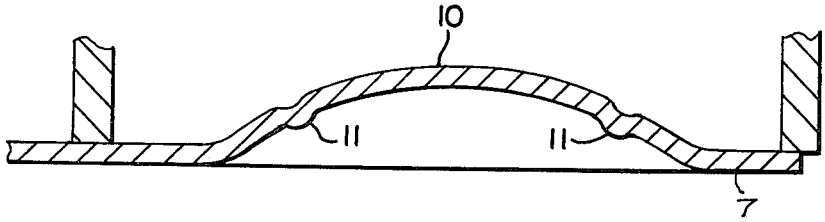
FIG. 5 is a horizontal sectional view corresponding to FIG. 4 with the tie bar removed.

Referring to FIGS. 2–5, the lading tie anchor installation 5 includes a vertical scoop member 7 and a tie bar 8. Intermediate its upper and lower ends, the elongated scoop member 7 has an elongated central concave portion indicated at 10 (FIGS. 4 and 5). The concave portion 10 has a pair of spaced vertically extending projections 11—11 which may be either continuous in the form of vertical ribs or which may be interrupted in the form of a series of vertically aligned detents of desired length. The projections 11 serve as locator formations for cooperating with rib formations 12—12 on the vertical edges of the tie bar 8. As will be observed from FIG. 4, the rib formations 12 fit over the projections 11—11 thereby cooperating therewith and serving as a means to readily locate the tie bar 8 in proper position in the scoop 17. Accordingly, it is merely necessary for a workman to place one of the tie bars 8 in the concave portion 10 of the scoop 7 in such manner that the rib locators 12 fit over the projection locators 11 and then weld the tie bar in place as indicated at 13—13.

The locator ribs 12—12 are not continuous but interrupted at regular intervals with the material at the sides of the tie bar in these intervals being bent inwardly over on the adjacent strip material as indicated at 14—14 (FIG. 4).

As stated above, a primary object of the invention is the provision of lading tie anchor installations which are economical both from the standpoint of cost of material and cost of installation. One of the contributing factors is the ease with which the tie bars 8 may be formed from relatively thin strip stock such as steel or aluminum of desired gauge and width. In addition to the edge formations 12 and 14 which are readily formed in the tie bar 8, the strip material is also subjected to a pressing operation which serves to impress in the central portion of the tie bar 8 repeating pairs of indentations 15—15 and 16—16. The indentation or rigidifying formations 15 and 16 are sufficiently close together between their narrower ends so as to provide a rigidifying formation which is indicated at 17.

The concave cross-section, vertical locator rib formations 12, inwardly bent double-thickness formations 14, together with the reinforcing indentations 15, 16 and 17 in the tie bar 8, all cooperate to rigidify the tie bar 8 so that it can be formed from relatively thin and light-weight stock and yet have adequate strength for its intended purpose. Likewise, the concave portion 10 of each scoop 7 and the locator formations 11 therein, also contributed to the strength of the assembly.

Conventional lading ties or straps can be readily passed through the spaces between the tie bar 8 and the scoop 7 and wrapped around the doubled-over smooth edges at 14 as indicated at T in FIG. 4.

It will be appreciated that the scoop members 7 can, and normally will, be located in both the side lining of a box car and in the doorpost channels. In FIG. 4, the scoop member 7 is indicated as being mounted in a doorpost channel 20. However, it will be understood that scoop members 7 can also be located in the side wall lining or steel side sheet depending upon the number and spacing of the lading tie anchor installations 5 that are desired.

Referring to FIGS. 6–9, a scoop member 21 is mounted in the doorpost channels or in the side lining of a box car as described above in connection with the embodiment shown in FIGS. 2–5. The scoop member 21 has an intermediate concave section 23 to which the tie bar 22 is welded or otherwise secured. In the middle of the concave section 23, there are a plurality of spaced, vertically-aligned projections 24—24 which serve as locator means for the tie bar 22.

The tie bar member 22 is concave in cross-section and is provided in the center with a plurality of spaced elongated reinforcing rib formations 25—25 which mate at their upper ends over the projections 24 in the scoop member 21. In this manner, the reinforcing ribs 25 and the projections 24 serve as cooperating locator formations for the proper positioning of the tie bar 22 in the scoop member 21. It will be seen that the tie bar 22 can, if desired, be raised relative to the projections 24 so that the projections will be located anywhere between the upper and lower ends of the reinforcing ribs 25. With the tie bar 22 in place in the scoop member 21, the lateral edges of the tie bar are welded to the scoop member as indicated at 26—26.

Figure 8:
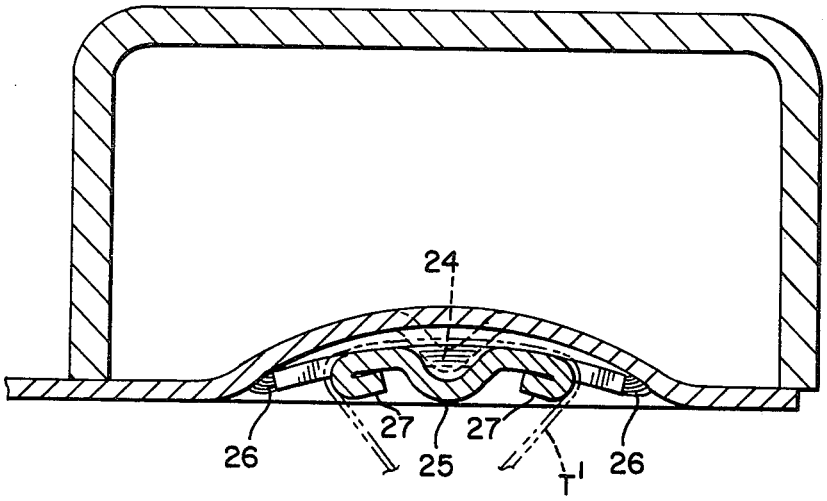
FIG. 8 is a horizontal sectional view on an enlarged scale taken on line 8—8 of FIG. 6.
Figure 6:
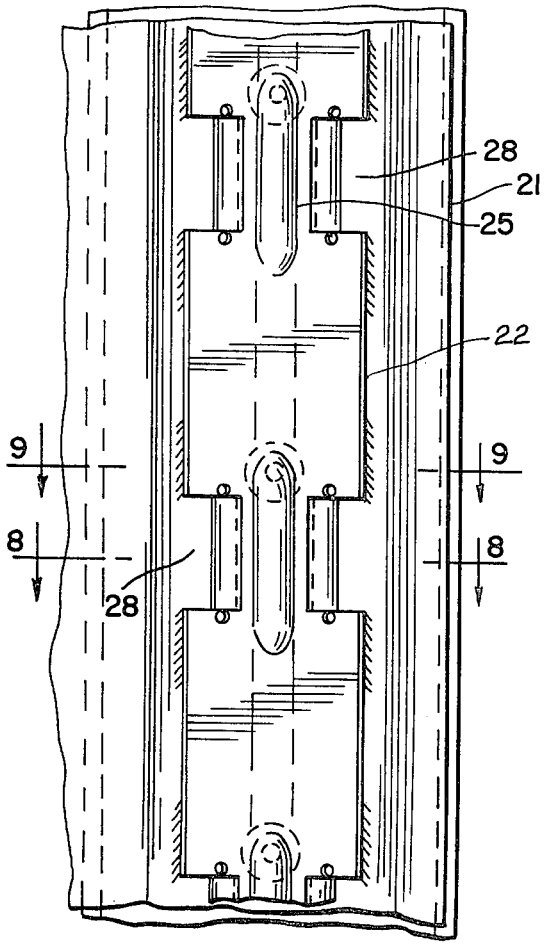
FIG. 6 is a fragmentary elevational view on an enlarged scale of the lading tie anchor portion within the broken line circle B in FIG. 1 and showing a second embodiment of the present invention.
Figure 7:
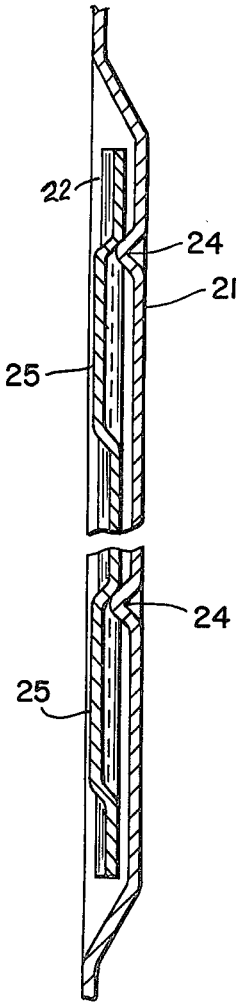
FIG. 7 is a fragmentary vertical sectional view taken on line 7—7 of FIG. 1 and on the same enlarged scale as FIG. 6 of the lading tie anchor embodiment shown in FIGS. 6–9.
Figure 9:
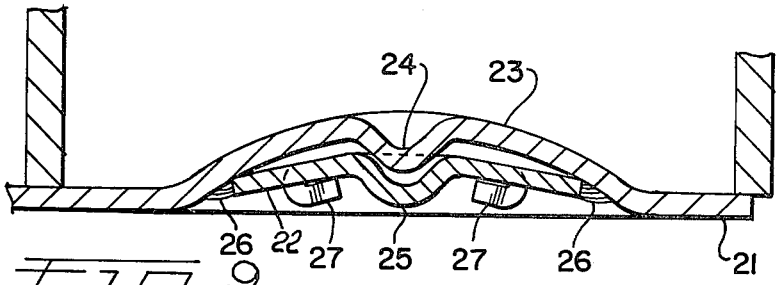
FIG. 9 is a horizontal sectional view similar to FIG. 8 but taken on line 9—9 of FIG. 6.

At regular intervals, the tie bar 22 is also provided with sections of uniform length wherein the strip material adjacent the side edges is doubled over outwardly or frontwards onto itself as indicated at 27—27 in FIGS. 8 and 9. The interruptions or breaks 28–28, provided by the turned-over edges 27, provide sufficient intervals in the tie bar 22 so as to accommodate conventional lading ties or straps as indicated at T′ in FIG. 8. The folded-over edges 27 also provide rounded edges for the lading ties and straps T′ to pass around.

It will be appreciated that the tie bar 22 may be formed from light-weight strip stock in an ecomomical fashion with the various features of the tie bar contributing to its strength. Thus, its concave cross-section, the presence of the reinforcing ribs 25, and the folded-over edges 27 all contribute to the strength of the tie bar. In addition, the concave shape of the scoop 23 and its projections 24 cooperate with the tie bar 22 to impart additional strength to the assembly.

In the light of the foregoing embodiments of the invention, it will be apparent that changes in detail may be introduced and other embodiments provided without departing from the spirit and scope of the invention.

What is claimed as new is:

1. Lading tie anchor means for installation in the side lining and doorpost channels of a box car comprising an elongated scoop member for securement in said side lining or channels and including a longitudinally extending concave section adapted to be recessed within said side lining or channels and having tie bar locator formations in said concave section, and a tie bar welded to and within said concave section, said tie bar being formed from a strip of light gauge material of uniform width so as to have repetitive series of formations therealong with each series including a wide section having a width only slightly less than said uniform width and the opposing edges of which are welded to said concave section of said scoop adjacent the side margins thereof, a narrow width section spaced from said concave section and the opposing free side edges of which are rounded and rigidified on being formed by folding margins of said light gauge metal over on itself, and rigidifying formations located partially in said narrow width sections; at least a portion of said rigidifying formations having tie bar locating-engagement with said tie bar locator formations in said concave section of said scoop.

2. Lading tie anchor means for installation in the side lining and doorpost channels of a box car comprising an elongated scoop member for securement in said side lining or channels and including a longitudinally extending concave section adapted to be recessed within said side lining or a doorpost channel and having tie bar locator formations in said concave section adjacent the margins thereof, a tie bar of generally concave cross-section welded to and within said concave section of said scoop member, said tie bar being formed from a strip of uniform width of light gauge metal so as to have repetitive series of formations therealong with each series including a wide section having a width somewhat less than said uniform width and the opposing edges of which are welded to said scoop member concave section adjacent the side margins thereof and the margins of each said wide section having rigidifying formations having mating engagement with said locator formations in said scoop member, a narrow width section spaced from said concave section and the opposing free edges of which are rounded and rigidified on being formed by folding margin portions over on itself in a direction to face toward said scoop member concave section, and additional rigidifying formations in the central portion of said tie bar in both said wide sections and said narrow sections.

3. In the lading tie anchor means called for in claim 2, said tie bar locator formations in said scoop member concave section being in the form of vertically-aligned inward projections and the side edges of said wide sections in said tie bar being in the form of vertical ribs which mate with said inward projections and thereby locate said tie bar for being welded in said scoop member concave section.

4. In the lading tie anchor means called for in claim 2, said tie bar locator formations in said scoop member concave section being in the form of vertical inward projecting ribs and the side edges of said wide sections in said tie bar being in the form of vertical ribs which mate with said vertical inward projecting ribs and locate said tie bar for being welded in said scoop member concave section.

5. In the lading tie anchor means called for in claim 2, said additional rigidifying formations having opposing narrow portions and opposing wide portions with the opposing narrow portions terminating in one of said narrow width sections.

6. Lading tie anchor means for installation in the side lining and doorpost channels of a box car comprising an elongated scoop member for securement in said side lining or channels and having a longitudinally extending concave section adapted to be received within said side lining or a doorpost channel and having in the center thereof a series of spaced vertically-aligned tie bar locator projections, a tie bar of generally concave cross-section welded to and within said concave section of said scoop member, said tie bar being formed from a strip of uniform width of light gauge metal so as to have repetitive series of formations therealong with each series including a wide section having a width somewhat less than said uniform width and the opposing edges of which are welded to said scoop member concave section adjacent the side margins thereof, a narrow width section spaced from said concave section and the opposing free edges of which are rounded and rigidified on being formed by folding margin portions over on itself in a direction away from said scoop member concave section, and spaced, vertically extending and aligned rigidifying formations in the central portion of said tie bar which mate with said tie bar locator projections in said scoop member concave section and thereby locate said tie bar for being welded in said scoop member concave section.

7. In the lading tie anchor means called for in claim 6, each of said spaced vertically extending and aligned rigidifying formations extending through one of said narrow width sections and on each end part way into the adjacent wide section.

* * * * *